United States Patent [19]

Rettke et al.

[11] Patent Number: 4,611,938

[45] Date of Patent: Sep. 16, 1986

[54] MECHANISM FOR RAISING AND FEEDING INK RIBBONS IN TYPEWRITERS AND SIMILAR MACHINES

[75] Inventors: Wilfried Rettke, Altdorf; Ladislav Tunys, Nuremberg, both of Fed. Rep. of Germany

[73] Assignee: Triumph Adler AG, Nuremberg, Fed. Rep. of Germany

[21] Appl. No.: 571,451

[22] Filed: Jan. 17, 1984

[30] Foreign Application Priority Data

Jan. 21, 1983 [DE] Fed. Rep. of Germany ..... 3301933

[51] Int. Cl.[4] ..... B41J 33/54; B41J 33/56

[52] U.S. Cl. ..... 400/212; 400/185; 400/213; 400/213.1; 400/216; 400/217; 400/225; 400/227.2; 400/232; 400/235.1; 400/208

[58] Field of Search ..... 400/185, 187, 206, 206.1, 400/207, 208, 208.1, 213, 213.1, 216, 216.1, 217, 225, 227.2, 232, 235.1

[56] References Cited

U.S. PATENT DOCUMENTS

| | | | |
|---|---|---|---|
| 3,346,090 | 10/1967 | Goff, Jr. et al. | 400/213.1 X |
| 3,348,650 | 10/1967 | Meinherz et al. | 400/213.1 |
| 3,604,549 | 9/1971 | Caudill et al. | 400/208 |
| 3,782,521 | 1/1974 | Hengelhaupt | 400/213.1 |
| 4,300,847 | 11/1981 | Hoffman et al. | 400/233 X |
| 4,302,118 | 11/1981 | Schaefer | 400/208 |
| 4,347,006 | 8/1982 | Shakib | 400/187 |
| 4,376,585 | 3/1983 | Fromme et al. | 400/185 |
| 4,411,541 | 10/1983 | Mansfeld et al. | 400/213 |
| 4,460,287 | 7/1984 | Theilen et al. | 400/213.1 |
| 4,472,073 | 9/1984 | Valle et al. | 400/216 X |

FOREIGN PATENT DOCUMENTS

| | | | |
|---|---|---|---|
| 0033532 | 8/1981 | European Pat. Off. | 400/208 |
| 8113008 | 10/1981 | Fed. Rep. of Germany . | |
| 3105229 | 12/1982 | Fed. Rep. of Germany . | |
| 3346482 | 7/1984 | Fed. Rep. of Germany | 400/208 |
| 2504859 | 11/1982 | France | 400/227.2 |
| 0013193 | 2/1981 | Japan | 400/208 |
| 0063494 | 4/1983 | Japan | 400/208 |
| 0126183 | 7/1983 | Japan | 400/185 |

OTHER PUBLICATIONS

IBM Technical Disclosure Bulletin, "Ribbon Sensitivity Adjustment", Cassidy et al, vol. 24, No. 12, May 1982, pp. 6541–6542.

IBM Technical Disclosure Bulletin, "Low Cost Cartridge Code Detector", Craft, vol. 25, No. 4, Sep. 1982, pp.1980–1981.

IBM Technical Disclosure Bulletin, "Proportional Ribbon and Correction Feed Mechanism that Does Both Lift and Feed with a Single Motor," Mink et al, vol. 26, No. 1, Jun. 1983, pp. 292–293.

IBM Technical Disclosure Bulletin, "Apparatus for Altering Ribbon Feed Increments", Blanck et al, vol. 26, No. 1, Jun. 19, 1983, pp. 301–303.

IBM Technical Disclosure Bulletin, "Unique Cam Arrangement for Printer Ribbon Feed Mechanism", Purcell et al, vol. 26, No. 1, Jun. 1983, pp. 67–68.

IBM Technical Disclosure Bulletin, "Variable Lift and Feed Increment Ribbon/Correction Mechanism", Greenlief et al, vol. 26, No. 3B, Aug. 1983, pp. 1580–1582.

*Primary Examiner*—Ernest T. Wright, Jr.
*Attorney, Agent, or Firm*—Joseph R. Spalla

[57] ABSTRACT

The invention concerns a mechanism for raising and feeding different types of ink ribbons in typewriters and similar machines. With a simple design and using only one motor under programmed control, the mechanism is capable of utilizing ink ribbons economically, e.g. printing alternately in several printing zones of a ribbon or in several colors. It also feeds ribbon by a length which corresponds to the type of ribbon, or type of operation, e.g. proportional typing. The starting point for the various functions is a basic position to which the mechanism is positioned by the motor.

8 Claims, 7 Drawing Figures

Fig_1
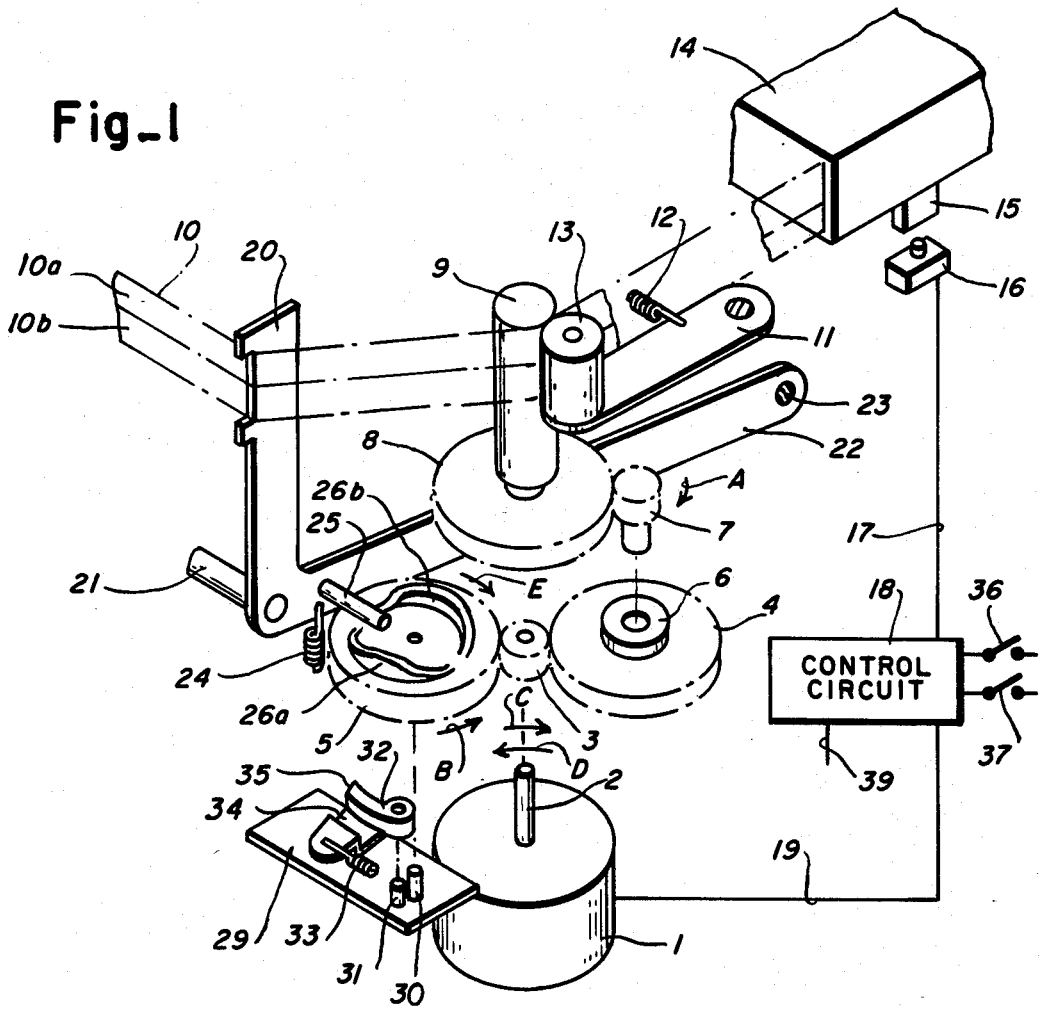
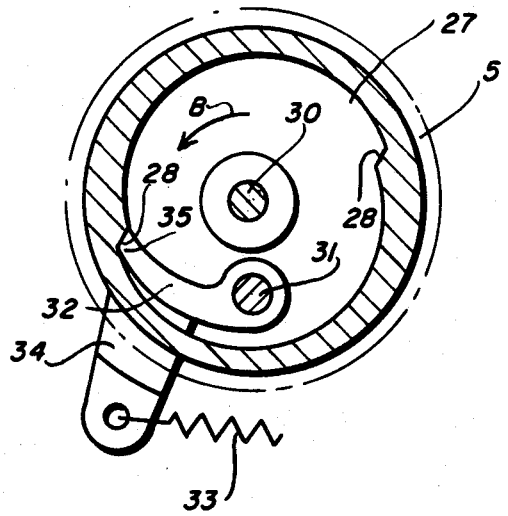
Fig_2

MECHANISM FOR RAISING AND FEEDING INK RIBBONS IN TYPEWRITERS AND SIMILAR MACHINES

The invention is a mechanism for raising and feeding various ink ribbons in typewriters and similar machines.

A sought for feature in printers of data processing systems is the ability to use different types of ribbons, e.g. two color fabric ribbons, one-time carbon ribbons, or so-called multistrike carbon ribbons. Prior art mechanism are known but are not versatile enough, e.g., German Pat. No. 3,105,229 corresponding to U.S. Pat. No. 4,411,541 shows a mechanism by means of which a ribbon can be printed upon in different printing planes for better utilization. By means of a hand lever it is possible to set the mechanism for different ribbon feed increments. Also German utility model No. 8,113,008 shows a mechanism in which ribbon feed increments can be set automatically according to the various types of ribbons by means of a coded structure on the ribbon cassette. These known devices, however, can only be used to a limited extent for the various types of ribbons. Besides, they have many parts which require considerable adjustment.

In accordance with the invention a single motor is employed to power mechanism for raising and feeding ink ribbons. The angular movement of the motor incident to printing is established in accordance with the selected type of ribbon or printing mode by a control circuit.

An object of the invention is to provide a mechanism for raising and feeding ribbon which can accommodate practically all known types of ribbons.

Another object of the invention is the provision of a mechanism for raising and feeding any type of ribbon which is as simple as possible requiring only a single driving motor and which is easily assembled without great adjustment.

Another object of the invention is to provide a ribbon raising and feeding mechanism powered by a single motor energized by a control circuit conditionable for utilization of any type of ribbon in an economical manner.

Other objects, features and advantages of the present invention will become better known to those skilled in the art from a reading of the following detailed description when taken in conjunction with the accompanying drawing wherein like reference numerals designate like or corresponding elements throughout the several views thereof and wherein:

FIG. 1 is an exploded perspective view of the ribbon raising and elevating mechanism;

FIG. 2 is an enlarged cross sectional view of the cam element of FIG. 1; and

Figure 3A:
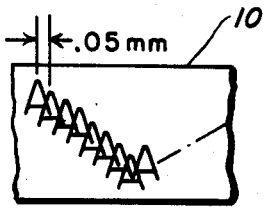

FIGS. 3 A–E are elevational views illustrating print patterns on various types of ribbon.

Referring now to the drawing wherein like reference characters designate like or corresponding parts throughout the several views there is shown in FIG. 1 a mechanism for raising and feeding ribbon in a simplified form. In particular parts that are not absolutely necessary for the understanding of the mechanism have been left out. The hereinafter described assembly of gear wheels, pawl, motor mount, ribbon guide bearing and the cassette receptacle will be arranged, e.g. on a movable carriage, as is generally known in typewriters or printers.

The mechanism is powered by a single motor 1 which drives by means of its shaft 2 a pinion 3 which engages two gear wheels, a feed gear wheel 4 and a lift gear wheel 5. Gear wheel 4 is connected to drive a pinion 7 in arrow direction A via a one-way clutch 6. Pinion 7 is drivingly engaged with a gear wheel 8 which drives a feed roller 9. On a swivel lever 11, which is under the action of a spring 12, there is arranged a counterpressure roller 13 for feeding ribbon 10 moving between the two rollers 9 and 13. For inserting ribbon 10, counterpressure roller 13 can be turned away by means of swivel lever 11.

Ribbon 10 is housed in a cassette 14 which can be mounted for operation by the mechanism in known manner and locked. Cassettes 14 containing one-time carbon ribbon 10 are provided with a lug 15 which acts on a one-time carbon ribbon mode switch 16, e.g. a microswitch. By means of a conductor 17, microswitch 16 is connected to a control circuit 18, such as a programmed microcomputer containing motor control programs corresponding to various ribbons or printing modes. An output line 19 is connected to motor 1 such as a stepping motor. The mode of operation of microswitch 16 in connection with control circuit 18 will be described below.

A ribbon guide 20, only one side of which is shown is adapted to guide ribbon 10 pulled out of a cassette 14 past a printing point. A cross bar 21 is provided to connect guide 20 shown in the drawing with another similar guide (not shown). Ribbon guide 20 has a bent-off arm 22 which is mounted for pivotal movement about hinge pin 23. A spring 24 is connected to pull guide 20 downwardly urging a cam follower pin 25 thereon against the upper face of gear wheel 5. As shown in FIG. 1 gear wheel 5 is in a basic position and ribbon 10 is positioned for printing through its upper track 10*a*.

Rising from the upper face of gear wheel 5, on which pin 25 normally bears, are two cams 26*a* and 26*b* located in opposite 180° sectors which are capable of raising pin 25 and thus ribbon guide 20 from its basic position. Furthermore, viewed from its underside, gear wheel 5 is designed as a hollow body so that a substantially circular recess 27 in whose inner periphery, as seen in FIG. 2 in which the upper face is cut away, are formed two opposing locking edges 28 whose function will be described below.

As shown in FIG. 1 the gear wheel 5 is rotatably mounted on a bearing pin 30 extending from a support plate 29. Plate 29 also supports a bolt 31 which serves as a pivotal support of a pawl 32 which is biased under the action of a spring 33. Pawl 32 is provided with a depressed web 34 which ensures sufficient room for the rim of gear wheel 5. Bolt 31 is so arranged that it protrudes together with pawl 32 mounted thereon into circular recess 27 of gear wheel 5. Spring 33 urges pawl 32 toward the inner circumference of recess 27 in such a way that one of the locking edges 28 bears against pawl nose 35 when gear wheel 5 is turned in the direction of arrow B in FIGS. 1 and 2. In the opposite direction of rotation, pawl 32 is inwardly cammed by the wall of the recess 27 toward bearing pin 30.

Two additional mode switches 36 and 37 act on control circuit 18 to select a motor energizing program. Switch 36 is a two-color fabric ribbon mode switch. Switch 37 is a proportional space mode switch. A line 39 to control circuit 18 is for signalling that the red color is to be printed when the fabric ribbon mode switch 36 is closed. The various types of operation of the mechanism incident to a print action in accordance with the selected type of ribbon and the required feeding step for the selected ribbon will now be described.

Turn-on Routine

When the printer or similar machine is switched on, the mechanism must be brought into a defined basic position which is the starting point for all following steps of the various functional sequences.

Thus when the printer is switched on a stored turn-on microprogram routine will cause the control circuit 18 to issue a sequence of pulses via line 19 to the stepping motor 1 to turn it in the direction of arrow C with the result that pinion 3 turns lift gear wheel 5 in the direction of arrow B. The number of pulses in the turn-on sequence is fixed and are sufficient to turn the gear wheel 5 from whatever angular orientation to which it was last turned, until one of the locking edges 28 of gear wheel 5 encounters nose 35 of pawl 32 arresting rotation of motor 1. This rotary position of gear wheel 5 is so selected that pin 25 of ribbon guide 20 bears on the upper face of gear wheel 5 between cams 26*a* and 26*b*, as shown in FIG. 1, whereby the upper track 1O*a* of ribbon 10 is at the level of the line to be printed.

Rotation of motor 1 in the direction of arrow C also rotates feed gear wheel 4 but due to the free wheeling of the one-way or overrunning clutch 6 in response to motor rotation in direction C the feed roller 9 is not turned by means of pinion 7 and gear wheel 8. The rotation of the motor 1 in direction C thus has no effect on the ribbon feed.

When lift gear wheel 5 has reached the predetermined basic position defined by engagement of a locking edge 28 with the pawl 32, motor 1 is restrained against further rotation, notwithstanding any remaining pulses in a turn-on sequence on line 19 from control circuit 18. Thereafter the microprogram resident in control circuit 18, to determine the number of pulses to be assigned to the stepping motor 1 via line 19 incident to each type or print action, is selected according to the ribbon type in the cassette 14 employed in the machine. It is to be understood that the control circuit 18, on command, will issue signals to effect the selection and printing of a character, either recorded in memory or generated by a keyboard (neither of which is shown), and that the pulse sequences will be issued to the motor 1 via line 19 in timed relationship to a commanded print action.

Operation with single color fabric or multistrike carbon ribbon

If cassette 14 is loaded with a fabric or a multistrike carbon ribbon, it will not have a lug 15. This means that the one-time carbon ribbon mode switch 16 is not actuated, neither will switches 36 or 37 be closed. Accordingly, assuming the completion of the turn-on microprogram routine to establish a basic position, the selected microprogram in control circuit 18, incident to each print action, will issue pulse sequences of, for example 6 pulses to the motor 1 causing it to turn in the direction of arrow D through 6 rotary steps corresponding for example to a turn of gear wheel 5 of 30°. This 6 step rotary movement has two consequences: On the one hand, feed roller 9 is driven via pinion 3, gear wheel 4, clutch 6, pinion 7 and gear wheel 8, so that ribbon 10 moves by a certain feeding step, e.g., 0.05 mm.

On the other hand, lift gear wheel 5 is also driven via pinion 3, and turns 30° in the direction of arrow E (FIG. 1). This 30° rotary movement occurs incident to each print action causing pin 25 to gradually raise and then lower again, thereby gradually raising and lowering ribbon 10, first by cam 26*a* during a 180° turn of gear 5, and then by cam 26*b*, producing a zig-zag pattern on the ribbon 10 as shown in FIG. 3A. The gradual raising of ribbon 10 can be tolerated since fabric and multistrike ribbon 10 can be substantially overstruck at substantially the same point several times by a printing type.

The two functions, feeding and raising, described in the foregoing paragraphs, caused by programmed pulse sequences issuing from the control circuit 18, continue until the printing of a text is completed. It is irrelevant whether the cassette 14 contains a stuffed endless ribbon or a spooled ribbon. By means of the gearing, an additional drive for a take-up reel in a spooled cassette 14 can be derived, e.g., from pinion 7. It is also possible to let the two rollers 9 and 13 protrude into the interior of cassette 14 for feeding ribbon 10.

Two Color (Red and Black) Fabric Ribbon

Figure 3D:
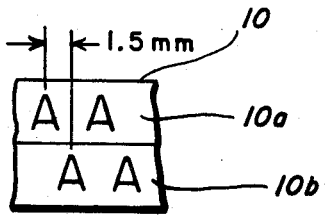
Figure 3B:
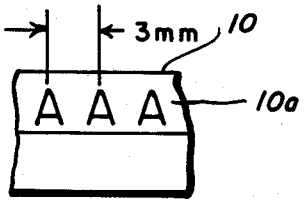

It should be noted that a fabric ribbon cassette 14 with a red and black ribbon would have no lug 15. With such a cassette 14 mounted the operator first actuates the two color fabric ribbon mode switch 36 which activates or selects a corresponding microprogram in control circuit 18. When the printer is turned on, the selected fabric ribbon microprogram first issues a turn-on routine to establish basic position, as described, locating pin 25 between cams 26*a* and 26*b*. Assuming no signal on line 39, the selected microprogram will be for printing on the black field 1O*a* of the ribbon 10 as shown in FIG. 3*b*. This selected microprogram will cause control circuit 18 to issue a sequence of 36 pulses incident to each print action to turn the motor 36 steps in the direction of arrow D from the basic position. Ribbon 10 is also moved, but by a corresponding larger amount of 3 mm as shown in FIG. 3B. Thirty-six steps will drive lift gear wheel 5 180° from basic position during which pin 25 rides up one of the cams 26*a*, 26*b*, but then slides down again so that the black zone 1O*a* is again at the level of the printing line for reception of a type impact. Before and after each print of a character this process repeats itself with the red field or zone 1O*b* always being raised during intervals between printing.

If red print is desired, the control circuit 18 is conditioned by a signal on line 39 so that a stored red fabric microprogram is selected to cause the control circuit 18 to now first issue a sequence of 18 pulses incident to the first type action to drive motor 1 in arrow direction D from basic position. This means, on the one hand, that ribbon 10 is first only moved 1.5 mm by means of rollers 9 and 13. On the other hand 18 motor steps causes gear wheel 5 to turn only 90° causing pin 25 to ride up to the center of one of the cams 26*a*, 26*b* and to remain in this high position until a character has been printed. As shown in FIG. 3C ribbon guide 20 is thus raised so far that red zone 1O*b* of ribbon 10 is at the level of the printing line. It is thus possible to print in red. Thereafter, 36 pulse sequences are issued incident to following print actions causing 180° turns from the 90° high position. As long as motor 1 continues to turn 36 steps, the printer prints in red zone 1O*b*. For switching back to black, motor 1 is first made to turn 18 steps, to restore pin 25 to basic position, and then again 36 steps as described above to print in the black zone 1O*a*. Thus for switching from zone 1O*a* to zone 1O*b* the motor 1 must turn once 18 steps in between to cause a rotation of gear wheel 5 by 90°.

Operation with One-Time or Single Pass Carbon Ribbon

If the printing is to be effected with a one-time carbon ribbon, it is necessary to mount a cassette 14 carrying one-time carbon ribbon and having a lug 15 adapted to actuate switch 16 which in turn activates a corresponding one-time carbon ribbon microprogram in control circuit 18.

After the turn-on routine the one-time carbon ribbon microprogram causes the control circuit 18 to issue 18 step pulse sequences incident to print actions. These cause a ribbon feed by means of rollers 9 and 13 of 1.5 mm each. At the same time gear wheel 5 incident to each print action is turned 90° corresponding to 18 motor steps so that pin 25 is once between the two cams 26*a* and 26*b* and alternately once on one of the cams 26*a*, 26*b*. This means that the machine prints alternately once on track 1O*a* and the next time on track 1O*b* as shown in FIG. 3D. Ribbon 10 is thus well utilized.

Operation in Proportional Print Mode

Where a proportional type font and a one-time carbon ribbon cassette 14 is mounted in the printer, the one-time carbon ribbon 10 must be moved by an amount which corresponds to the widest letter, e.g. to the letter "W", in order to avoid that a following character is printed partly on a ribbon point that is already worn out.

For operation in a proportional print mode a proportional printing microprogram in the control circuit 18 is selected by closing switch 37, with switch 36 in open position, and switch 16 is actuated by a lug 15 on the one-time carbon ribbon cassette 14.

After a turn-on routine as described the selected microprogram causes the control circuit 18 to issue to motor 1 a 21 step pulse sequence to turn motor 1 in the direction of arrow D from basic position. This rotary movement of motor 1 is transformed into a corresponding 1.75 mm feeding movement of ribbon 10.

At the same time gear wheel 5 is driven by motor 1 in the direction of arrow E, which has the result that ribbon guide 20 is raised by one of the cams 26*a*, 26*b*. But since motor 1 has turned 21 steps, as mentioned above, pin 25 rides beyond the 90° (18 step) high point of one of the cams 26*a*26*b*, so that ribbon 10 is not at the predetermined printing level 1O*b*. The microprogram therefore causes the control circuit 18 to issue a three step pulse sequence to turn motor 1 back again by 3 steps in the direction of arrow C. This ensures that pin 25 is exactly at the high or 90° level of cams 26*a*, 26*b*, and ribbon 10 is set exactly to printing zone 1O*b*. During the next 21 step sequence of motor 1 incident to a print action, pin 25 runs somewhat into the face of the next cam 26*a*, 26*b*, but resumes a basic position between cams 26*a* and 26*b* when motor 1 turns back again by the above-mentioned three steps. Ribbon 10 with printing zone 1O*a* is then at the level of the printing line.

The backward rotations of motor 1 by three steps has no effect on feed roller 9, since no motion is transmitted by one-way clutch 6 on gear wheel 4 when motor 1 turns in direction C.

Figure 3E:
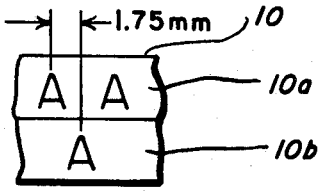
Figure 3C:
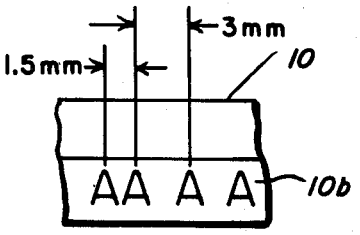

The printing of the characters on carbon ribbon 10 is effected as shown in FIG. 3E, i.e. alternately in zone 1O*a* and 1O*b*, only the distance from character to character is 1.75 mm.

With certain designs of cams 26*a*, 26*b* it would be possible that pin 25 would be at the high point of a cam 26*a*, 26*b* after 21 steps, and that ribbon 10 also would be at its predetermined level. The correction by three steps backward, however, is necessary, otherwise the additional steps would add up after several operations, which would lead to wrong settings of the level of the carbon ribbon 10. The printing of a character can take place, however, while motor 1 turns back by the three steps, since this movement, as mentioned above, is not effective to feed ribbon 10.

General

The foregoing considerations show that 18 steps of motor 1 cause a rotation of gear wheel 5 by 90°. A change within the printing zones 1O*a*, 1O*b*, is thus possible. But if the machine is to print constantly in one printing zone 1O*a* or 1O*b*, motor 1 must turn by 36 steps so that gear wheel 5 performs its rotation of 180°. Pin 25 of ribbon guide 20 is thus always on or between cams 26*a* and 26*b*. The setting of the type of operation of the mechanism remains until a change is made by one of the switches 16, 36 or 37.

The microprograms necessary for the various types of operation can be integrated simply into an electronic component of control circuit 18 in today's state of the art.

The indicated number of steps of motor 1 and the feeding steps length in mm for ribbon 10 are only given by way of example to facilitate the understanding of the functional sequences. The various data can also be based on other values if other conditions necessitate it. The length of the feeding paths for ribbon 10 in dependence on the respective number of rotary steps of motor 1 depends on the transmission ratio of the gearing 3 and 5, and of 3 and 4, 7, and 8.

Instead of a stepping motor 1, a d-c motor (not shown) provided with a timing disk, can be used where the rotary steps are counted, e.g. by means of a light barrier on the timing disk.

The invention is described by the example of a printer, e.g. for printing the data output of a data processing system. If the device is used in a typewriter, minor changes which do not directly concern the described mechanism and its functions may be required.

The invention claimed is:

1. Mechanism for raising and feeding according to type any of a plurality of types of inked print ribbons comprising a ribbon feed gear wheel, a ribbon lift gear wheel having cam means, a follower engaging said cam means to be driven thereby to raise a ribbon guide, a stepper motor including an output gear coupled to rotate said feed and lift gear wheels through various angles, a microcomputer including a plurality of stored programs corresponding to types of print ribbons to be used, and input means signalling said computer to select from the stored programs the one corresponding to the ribbon type selected for use, said selected stored program causing said microcomputer to issue a predetermined number of motor energizing pulses to effect rotation through a predetermined angle whereby the magnitude of ribbon lift and ribbon feed is controlled according to the selected type of print ribbon in use.

2. For use in typewriters or like machines, a system for controlling the raising and feeding according to type any of a plurality of types of inked print ribbons mounted for use in the machine comprising, a bidirectional stepping motor having an output shaft, a microcomputer having a plurality of stored motor control programs corresponding to the plurality of types of inked print ribbon, each of said programs causing said microcomputer to issue to said motor a predetermined number of pulses incident to each print action to rotate said motor in a first direction through a predetermined angle, input means signalling said microcomputer to select one of said plurality of stored motor control programs for operation according to the type of inked print ribbon mounted for use in the machine, a lift gear wheel, cam means comprising rising and falling cam surfaces on the face of said lift gear wheel, a ribbon guide having cam follower means engaging said cam surfaces on the face of said cam means for controlling the movement of said ribbon guide to levels determined by the angle of rotation of said lift gear wheel, a feed gear wheel, ribbon feed means coupled to be unidirectionally driven by said ribbon feed gear by an amount determined by the angle of rotation of said ribbon feed gear, and means coupling said motor output shaft to rotate said lift and feed gear wheels simultaneously through the angle determined by the predetermined number of pulses applied to said motor by said microcomputer.

3. A system as recited in claim 2, said stored motor control programs including a turn-on routine for issuing pulses to said motor to rotate said motor output shaft in a second direction to return said lift gear wheel to a basic position, and unidirectional rotational limit means positioned to arrest said lift gear at a basic position.

4. A system as recited in claim 2, wherein the number of pulses caused to be issued incident to each type action by the selected stored motor control program for printing through a single color fabric or multistrike print ribbon effects rotation of said motor and lift gear wheel in said first direction through angles sufficient only to lift the ribbon guide from rest position gradually to define an overlapping zig-zag pattern on the print ribbon.

5. A system as recited in claim 2, wherein the number of pulses caused to be issued incident to each type action by the selected stored motor control program for printing through one level of a two-color print ribbon effects rotation of said motor and lift gear wheel in said first direction through angles sufficient to move the ribbon guide from a rest position to a raised position and back incident to each type action.

6. A system as recited in claim 2, wherein the number of pulses caused to be issued incident to each type action by the selected stored motor control program for printing through a one-time carbon print ribbon effect rotation of said motor and lift gear wheel in said first direction through angles which move the ribbon guide on alternate typing stroked between maximum and minimum lift positions and effect feed of said print ribbon through a correspoding feed increment.

7. A system as recited in claim 6, said input means signalling said microcomputer including a one-time print ribbon cartridge actuated switch.

8. A system as recited in claim 7, said input means signalling said microcomputer including a mode switch for selecting a program providing a larger feed increment.

* * * * *